United States Patent [19]

Rand

[11] 4,031,674

[45] June 28, 1977

[54] INFLATABLE TENT

[76] Inventor: J. Patrick Rand, 2357 Onyx St., Eugene, Oreg. 97403

[22] Filed: Jan. 19, 1976

[21] Appl. No.: 650,328

[52] U.S. Cl. ..... 52/2; 52/DIG. 10; 135/1 R; 135/14 D; 126/270

[51] Int. Cl.[2] ..... E04B 1/345

[58] Field of Search ..... 52/2, DIG. 10; 126/270, 126/271; 135/1, 14 D

[56] References Cited

UNITED STATES PATENTS

| | | | |
|---|---|---|---|
| 2,961,194 | 11/1960 | Thorness | 52/DIG. 10 |
| 3,153,235 | 10/1964 | Chatelain | 52/2 |
| 3,250,024 | 5/1966 | Douthitt | 52/2 |
| 3,415,582 | 12/1968 | Trexler | 52/2 |
| 3,768,467 | 10/1973 | Jennings | 52/2 |
| 3,800,735 | 4/1974 | Simpson | 52/2 |
| 3,841,039 | 10/1974 | Farnsworth | 52/DIG. 10 |
| 3,924,364 | 12/1975 | Eerkens | 52/2 |

FOREIGN PATENTS OR APPLICATIONS

| | | | |
|---|---|---|---|
| 912,280 | 8/1946 | France | 52/DIG. 10 |

OTHER PUBLICATIONS

The Sun at Work, Newsletter of the Association for Applied Solar Energy, Arizona State University, Reprinted from the Sun at Work, Second Quarter Issue 1960.

*Primary Examiner*—Price C. Faw, Jr.
*Assistant Examiner*—Henry Raduazo
*Attorney, Agent, or Firm*—Griffin, Branigan and Butler

[57] ABSTRACT

An inflatable tent is in the shape of a non-planar tetrahedron. The tent is formed from a single rectangular, planar sheet joined with itself along three linear seams.

2 Claims, 4 Drawing Figures

INFLATABLE TENT

BACKGROUND OF THE INVENTION

This invention relates to tent structures, and more particularly to inflatable tent structures. The tent has particular use as a short-term shelter for recreational camping or emergency housing, or as a collapsible darkroom, sauna, or the like within a conventional structure.

Tents have traditionally used mechanical support systems comprising various poles, arches, stakes, and lines. These support systems have often been complicated and have frequently failed during adverse conditions. More recently, pneumatic support methods have been developed. For example, flexible tubes, filled with high pressure fluid, have served as columns or arches from which tent membranes have been hung. Because high pressure has been required in these systems, however, quality control of the flexible tubes is a major problem.

Advantages and disadvantages of individual tents are often determined by the specific material chosen as the tent membrane. Canvas-like materials are durable, water-repellent, and "breatheable"; however, they are also heavy and bulky. Synthetic fibers such as nylon produce durable and yet lightweight tent membranes; however, to make nylon waterproof, it must be coated with a plastic, such as urethane, which is not breathable. Hence, condensation of moisture from the breath of users of the tent becomes a considerable problem. To avoid condensation many modern tents use breatheable, non-waterproof, inner membranes and waterproof outer membranes supported away from the first membrane. This, of course, leads to undesirable complexity and bulk.

Also, even where the condensation problem is either ignored or reduced by proper ventilation, any pinholes in the plastic coating inevitably lead to leaks in the membrane.

The problem of leaks can be reduced somewhat by supporting synthetic-fiber tents with pneumatic systems which inflate the entire tent structures to a pressure slightly above ambient pressure. In this regard, the higher interior pressure helps repel water at membrane faults. Further, the air used to inflate the tents is continuously or periodically replaced and thereby also reduces the condensation problem. The present invention is particularly adaptable to this support method.

But even where an open pneumatic system is used with synthetic-fiber tents, the problem of water leakage is still found to a small extent along the seams of the membranes. A reason for this is that the threads used in sewing seams do not completely fill the holes formed in the waterproof coatings during sewing. It is therefore an object of this invention to provide a pneumatically-supported tent having a minimized total seam length for a given tent volume.

In the tent making process, it is also preferred that seams be linear to avoid the obvious problems created by curved seams in both cutting and sewing operations. It is therefore another object of this invention to provide a tent structure which may be formed using only linear seams.

Because of the chance that a system used to inflate a tent may fail, it is a further object of this invention to provide a tent which may be easily supported by mechanical means when necessary.

It is known that the most suitable color of a tent membrane may vary according to the environmental conditions. For example, during the winter one might prefer a dark color which will absorb the sun's rays. However, during the summer months, one would prefer a color which would reflect the rays.

It is therefore an object of this invention to provide a tent which permits a user to vary the color of the tent membrane exposed to direct sun rays as environmental conditions dictate.

Finally, it is an object of this invention to provide a tent which may be reduced to a flat rectangular sheet for simple folding.

SUMMARY

The tent disclosed herein is formed from a rectangular sheet of tent material into the shape of a tetrahedron. The support means is preferably an open pneumatic system.

BRIEF DESCRIPTION OF THE DRAWINGS

The foregoing and other objects, features, and advantages of the invention will be apparent from the following more particular description of a preferred embodiment of the invention, as illustrated in accompanying drawings in which like-reference characters refer to the same parts throughout the different views. The drawings are not necessarily to scale, emphasis instead being placed upon illustrating principles of the invention.

DESCRIPTION OF A PREFERRED EMBODIMENT

Figure 1:
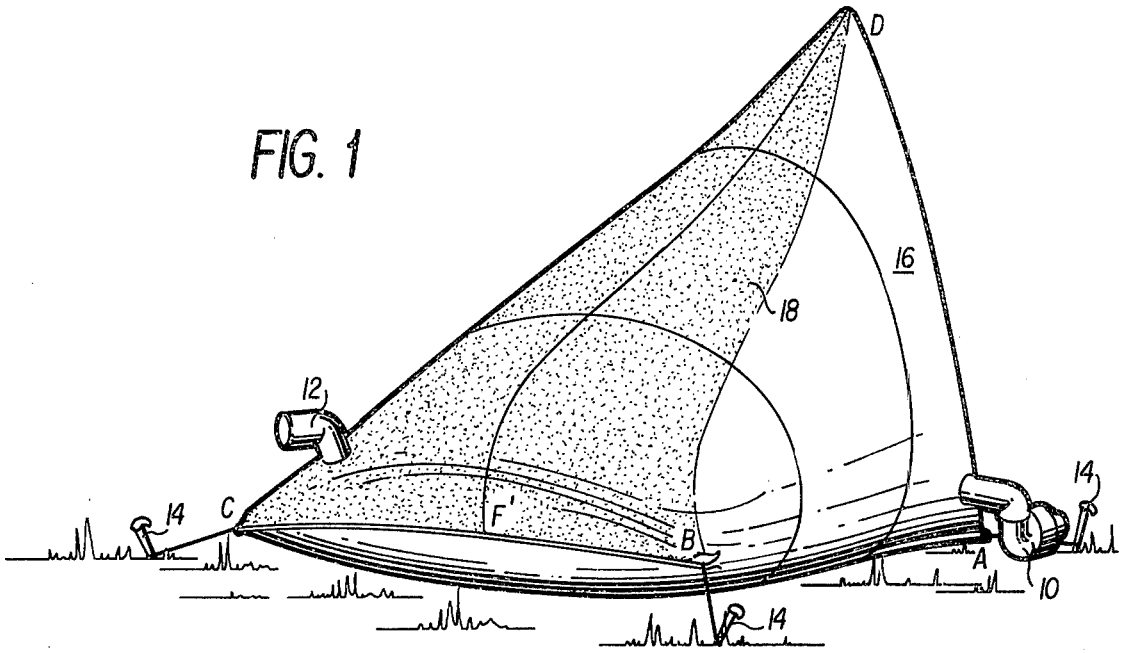
FIG. 1 is an isometric view of a tent constructed according to this invention.
Figure 4:
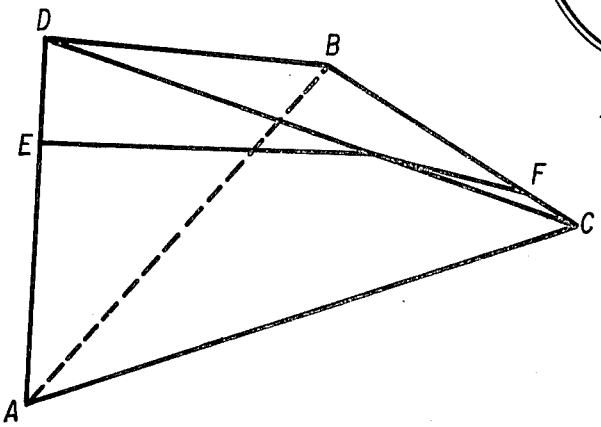

FIG. 1 depicts a tent structure in the shape of a non-planar tetrahedron. The tetrahedron is referred to as being non-planar because of curved edges AB, BD, DC, and CA. FIG. 4 is a simplified planar representation of the tent of FIG. 1 as seen from another direction. In the embodiment shown in FIG. 4, only three linear seams are required: AD, BC, and EF. The non-planar tetrahedron is believed to have the greatest volume per seam length of any shape formed from planar membranes. It is also significant that all seams are linear, thereby simplifying the sewing operation. To permit access to the tent, seam AD should be in the form of a zipper or the like.

It is apparent from both FIGS. 1 and 4 that the tent is constructed to form an irregular, as opposed to an equilateral, tetrahedron.

As is noted above, the preferred support for the tent is pneumatic. Accordingly, an electric blower 10 is provided to inflate the tent. The blower 10 may be powered by a battery or any suitable electric source. A vent or damper 12 allows for a controlled exhaust of air from the tent. Because the air in the tent is continuously or periodically refreshed, the need for a breathable tent membrane is eliminated. As was mentioned above, exhaled moisture is removed before it is able to condense inside the tent. Hence, the tent's entire membrane may be made of urethane-coated nylon or other synthetic tent fabrics. As is also noted above, problems due to pin-holes in the tent membrane are reduced because of the higher than atmospheric pressure inside the tent and the reduced seam length.

As an alternative to the pneumatic support of the tent, or in case of blower failure, the tent may be supported by a line, post, or other means from point D. With either support system, it is preferred that anchors 14 be used at points A, B, and C to hold the tent in a fixed position on the ground.

As is further noted above, various environmental conditions suggest the use of various colors for the tent's membrane. Accordingly, different sides of the tetrahedron tent have different colors. If a zipper seam is then provided at seam BC as well as at AD, the tent can be rolled to any of its sides to optimize solar heat gain characteristics with either BC or AD serving as the entrance.

Figure 2:
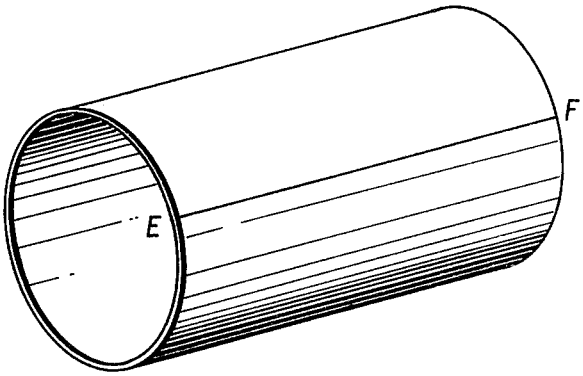
FIG. 2 is an isometric view of the tent of FIG. 1 during a first step of its construction.
Figure 3:
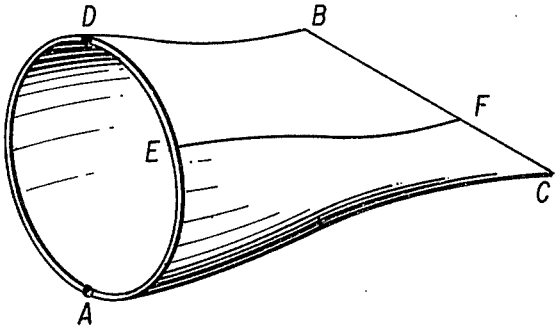
FIG. 3 is an isometric view of the tent of FIG. 1 during a second step of its construction, and, FIG. 4 is an isometric view of a simplified planar representation of the tent of FIG. 1 as seen from another direction.

Regarding construction of the tent, with reference to FIGS. 2 and 3, the tent is formed from a single rectangularly shaped planar sheet. The sheet is formed into a cylinder, as shown in FIG. 2, by joining opposed ends of the sheet along seam EF. One end of the cylinder is then closed by a second linear seam BC, which, in the case of a rectangular sheet, is perpendicular to seam EF. To complete the tent, a zipper is provided at the remaining open end. When the zipper is closed, a third linear seam, perpendicular to the first two, is formed at AD.

Of course, by turning the cylinder of FIG. 2 before sewing seam BC, seam EF can be positioned along a preferred line in the finished product. For example, the seam is shown as DF′ in FIG. 1. FIG. 1 also shows additional seams 16 and 18, which may be required due to size limitation of membrane sheets.

From FIG. 3, it can be seen that when the zipper seam AD is open, the tent can again be flattened to a rectangular sheet for ease in folding.

While the invention has been particularly shown and described with reference to a preferred embodiment thereof, it will be understood by those skilled in the art that various changes in form and detail may be made therein without departing from the spirit and scope of the invention.

What is claimed is:

1. A camping tent comprising a flexible tent membrane and a separate tent support means, said tent membrane having the shape of a non-planar irregular tetrahedron when supported by said support means, said tent being formed from a substantially rectangular sheet, first and second opposed edges of said sheet being joined along a first seam, a third edge of said sheet being joined with itself along a second seam substantially perpendicular to said first seam, and a fourth edge of said sheet being joined with itself along a third seam substantially perpendicular to both said first and second seams, at least one of said second and third seams comprising a zipper, said support means comprising a blower communicating with said tent membrane for blowing air into said tent membrane and a vent, said vent cooperating with said blower to replace air in said inflatable membrane and to regulate internal pressure.

2. The tent of claim 1 wherein at least two sides of said tent are of colors having different energy absorbing characteristics.

* * * * *